US006796071B2

(12) United States Patent
Lane et al.

(10) Patent No.: US 6,796,071 B2
(45) Date of Patent: Sep. 28, 2004

(54) GUN LOCK

(76) Inventors: Kenneth M. Lane, 6 W. Shore Rd., North Oaks, MN (US) 55127; Woodrow W. Lane, 2351 Lonestar Dr., Norco, CA (US) 92860

( * ) Notice: Subject to any disclaimer, the term of this patent is extended or adjusted under 35 U.S.C. 154(b) by 0 days.

(21) Appl. No.: 09/839,353

(22) Filed: Apr. 20, 2001

(65) Prior Publication Data

US 2002/0152662 A1 Oct. 24, 2002

(51) Int. Cl.[7] ..... F41A 17/00

(52) U.S. Cl. ..... 42/70.11; 42/70.01

(58) Field of Search ..... 42/70.11, 70.01

(56) References Cited

U.S. PATENT DOCUMENTS

| | | | | |
|---|---|---|---|---|
| 2,327,334 A | | 8/1943 | Parker | |
| 2,479,107 A | | 8/1949 | Garretson | |
| 2,887,807 A | | 5/1959 | Santangelo | |
| 3,022,598 A | * | 2/1962 | Wikstrom | 102/430 |
| 3,360,880 A | * | 1/1968 | Finnegan | 42/66 |
| 3,710,490 A | * | 1/1973 | Cornett et al. | 42/70.11 |
| 4,512,099 A | | 4/1985 | Mathew | |
| 4,783,924 A | * | 11/1988 | Thurber | 42/70.11 |
| 4,908,971 A | * | 3/1990 | Chaney | 42/70.11 |
| 4,969,284 A | * | 11/1990 | Healey et al. | 42/70.11 |
| 5,138,785 A | | 8/1992 | Paterson | |
| 5,289,653 A | | 3/1994 | Szebeni et al. | |
| 5,357,704 A | | 10/1994 | Benkovic | |
| 5,488,794 A | * | 2/1996 | Arrequin | 42/66 |
| 5,491,918 A | | 2/1996 | Elmstedt | |
| 5,628,136 A | * | 5/1997 | Wickser, Jr. | 42/95 |
| 5,664,358 A | * | 9/1997 | Haber et al. | 42/70.11 |
| 5,699,687 A | | 12/1997 | Pittman | |
| 6,041,536 A | * | 3/2000 | Samuels et al. | 42/70.11 |

OTHER PUBLICATIONS

"Smart Trigger Lock", Gadget Universe catalog, p. 28 (date unknown) These products are believed to have been known and used by others in this country before the filing date of this application.

"PistolPal®", Palmer Security Products, America's 1st Freedom, p. 26 (Jan. 2001).

"The Gunlocker™", America's 1st Freedom, p. 69 (Jan. 2001).

"Gun Vault®", America's 1st Freedom, p. 71, (Jan. 2001).

SIGARMS "Electronic Personal Locking System", Gun Guide, p. 22 (2001).

"The Basic Rules of Firearm Safety", GLOCK, Inc. brochure (date unknown) These products are believed to have been known and used by others in this country before the filing date of this application.

"Cable Lock", Beretta Worldwide Catalog, (date unknown) These products are believed to have been known and used by others in this country before the filing date of this application.

AirLite Ti™ Kit Guns, Smith & Wesson Handguns, p. 72 (2000).

"AirLite Ti™ Personal Defense", Smith & Wesson Handguns, p. 73 (2000).

(List continued on next page.)

*Primary Examiner*—Michael J. Carone
*Assistant Examiner*—M Thomson
(74) *Attorney, Agent, or Firm*—Merchant & Gould P.C.

(57) ABSTRACT

A safety lock for a firearm. The safety lock has an engagement member moveable between a locked and an unlocked position. The lock is secured within a gun by inserting the lock in the barrel of the gun, and then moving the engagement member from the unlocked position to the locked position. In the locked position, the engagement member engages structure in the firing chamber of the gun, thereby securing the safety device within the firearm.

29 Claims, 3 Drawing Sheets

OTHER PUBLICATIONS

"Fumbling Gun Locks and Funneling Money", America's First Freedom, p. 52 (Jun. 2000).

Galazan newspaper and showing "cable lock", "trigger lock" and "speed release gun lock", p. 28 (date unknown) These products are believed to have been known and used by others in this country before the filing date of this application.

"Keeping the Trigger Locked", White Bear Press, pp. 1a and 7a, (Oct. 11, 2000).

Farrell, Scott "A Lock on the Market"; Guns Magazine (May 2001).

"Springfield Integral Locking System", Shooting Times, 2 pages (May 2001).

"Gun Blok™"; Shot Lock Keyed Gun Locks, Cabela's catalog, p. 528 (date unknown) These products are believed to have been known and used by others in this country before the filing date of this application.

"Ruger® Padlocks and Cable Locks", American Rifleman, 1 page (date unknown)* These products are believed to have been known and used by others in this country before the filing date of this application.

"Chamber–Safe from Rocky Mountain Tool and Armory", http://www.fieldandstream.com/fieldstream/gear/finder/article/0,13440,195859,00.html (date unknown) and two corresponding photos Thes products are believed to have been known and used by others in this country before the filing date of this application.

"INTERBORE™ High Security Handgun Bore Lock", 2 pages and two corresponding photos (date unknown) These products are believed to have been knwon and used by others in this country before the filing date of this application.

"The Interbore Gun Lock", http://www.fenrir.com/interbore/interbore.htm, 3 pages (date unknown) These products are believed to have been known and used by others in this country before the filing date of this application.

Two photos showing "Pistol Lock", Gunsafe Pty Ltd, (date unknown) These products are believed to have been known and used by others in this country before the filing date of this application.

* cited by examiner

GUN LOCK

FIELD OF THE INVENTION

The present invention relates to a security device, and more specifically to a lock for use in a firearm, such as a handgun, rifle or shotgun.

BACKGROUND OF THE INVENTION

Firearm use and ownership has increased in recent years. Those owning guns range from the casual gun collector to those using guns for recreational or protective purposes. The various guns that are owned also differ considerably in shape and size, from the small, concealable handgun to rifles and shotguns.

Along with this increased firearm ownership and use has come an enhanced concern for firearm safety. This includes a concern for preventing accidental discharge or unauthorized use of the gun.

Safety devices have been introduced to address this concern. For example, there are various types of gun locks that are available. Many of these, however, are ineffective because, for example, they can be easily disarmed, difficult to install or fail to prevent discharge of the gun when installed. Also, many are only useful on limited types of guns. Therefore, there is a need for a reliable gun lock that can be used on a variety of gun types.

SUMMARY OF THE INVENTION

The present invention relates to a safety lock for a firearm. The safety lock has an engagement member moveable between a locked and an unlocked position. The lock is secured within a gun by inserting the lock in the barrel of the gun, and then moving the engagement member from the unlocked position to the locked position. In the locked position, the engagement member engages structure in the firing chamber of the gun, thereby securing the safety device within the firearm. When locked within the gun, the lock is preferably substantially contained within the bore of the firearm to reduce the likelihood of tampering. Also, the engagement member of the lock is preferably biased toward the locked position. Further, a key for unlocking and locking the lock is preferably removable from the lock only when the lock is in the locked position. Moreover, the lock is preferably adjustable in length.

A variety of advantages of the invention will be set forth in part in the description that follows, and in part will be apparent from the description, or may be learned by practicing the invention. It is to be understood that both the foregoing general description and the following detailed description are exemplary only and are not restrictive of the invention as claimed.

BRIEF DESCRIPTION OF THE DRAWINGS

The accompanying drawings, which are incorporated in and constitute a part of the specification, illustrate several aspects of the invention and together with the description, serve to explain the principles of the invention. A brief description of the drawings is as follows.

DETAILED DESCRIPTION

Reference will now be made in detail to exemplary aspects of the present invention that are illustrated in the accompanying drawings. Wherever possible, the same reference numbers will be used throughout the drawings to refer to the same or like part.

Figure 1:
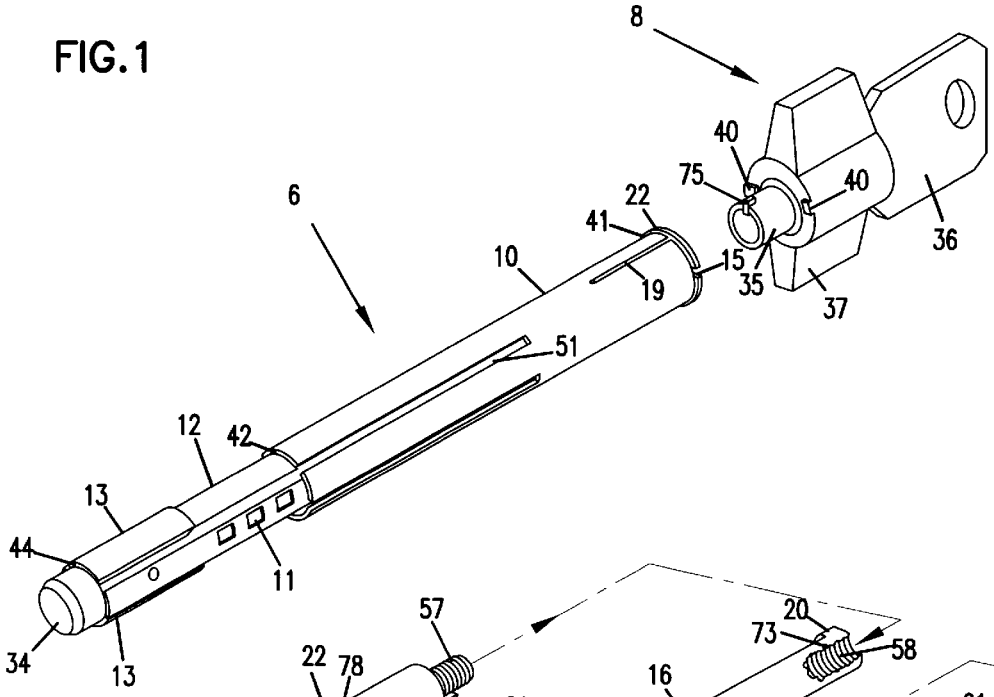
FIG. 1 is a perspective view of a firearm lock and key constructed in accordance with the principles of the present invention.

FIG. 1 illustrates a firearm lock 6 constructed in accordance with the principles of the present invention. The lock 6 includes an elongated body formed by an outer piece 10 that slides over and connects to an inner piece 12. The lock 6 also includes locking lugs 13 that are moveable between a radially expanded orientation (shown in FIGS. 8 and 10) and a radially contracted orientation (shown in FIG. 9). In the radially expanded orientation of FIGS. 8 and 10, the lugs 13 are adapted to retain the lock 6 within a firearm 1. In the radially contracted orientation of FIG. 9, the lock 6 can be removed from or inserted into the firearm 1. A key 8 is preferably used to move the lugs 13 between the radially expanded and contracted orientations. Preferably, a biasing structure (e.g., a torsion spring 17 such as the one shown in FIG. 2) is used to bias or urge the lugs 13 toward the expanded orientation.

In the embodiment of FIG. 1, the lock 6 is an integral unit. Since the lock is an integral unit, the firearm in which it is installed may quickly be restored to functionality by unlocking and removal of the unitary lock assembly. The described embodiment includes features which ensure that, if the device is installed fully in the bore and the key 8 is removed, the device is locked and the firearm is secure. In other words, preferably the key 8 can not be removed from the lock 6 unless the lugs 13 are in the expanded orientation. Thus, the presence of the key 8 within the lock 6 while the lock is inserted within a firearm is an indicator (i.e., warning flag) that the firearm may not be locked or inoperable.

Figure 4:
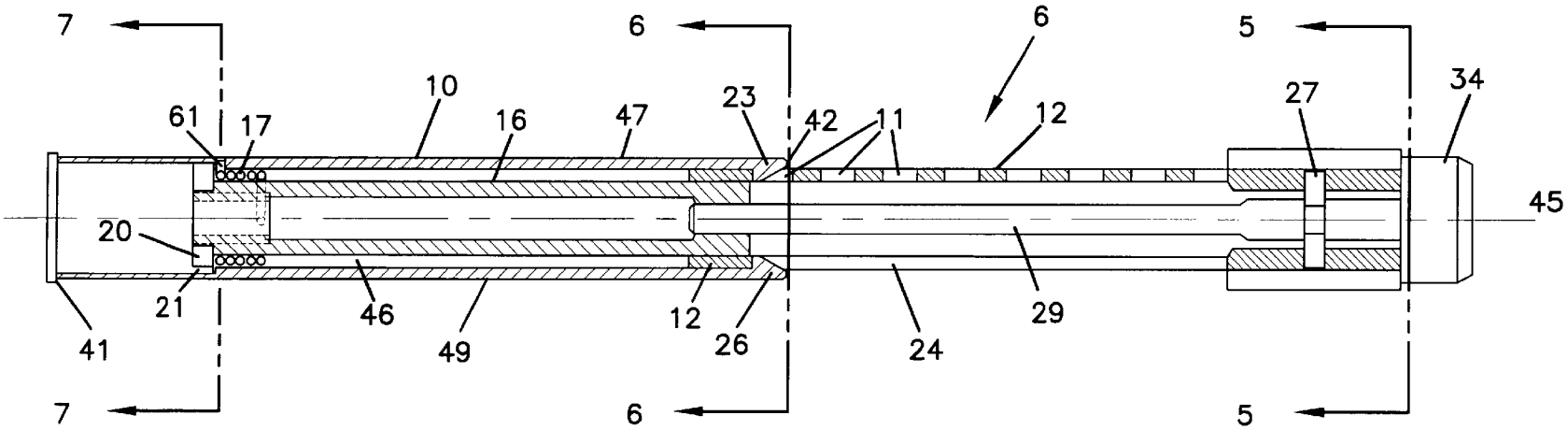
FIG. 4 is a cross-sectional view of the firearm lock of FIG. 1 with the lock being bisected along its length.

Referring to FIG. 4, the outer piece 10 of the firearm lock 6 extends along a longitudinal axis 45 and includes a front end 41 positioned opposite from a rear end 42. The front and rear ends 41 and 42 of the outer piece 10 are open with a bore 46 (see FIG. 2) formed therebetween extending along longitudinal axis 45.

The outer piece 10 is slidably engaged with and telescopes over inner piece 12. The outer piece 10 engages inner piece 12 at one of a plurality of discrete positions on the inner piece 12. The length of the lock 6 varies depending on the position at which the outer piece 10 engages inner piece 12. This in turn enables the firearm lock 6 to be used on guns having different length firearm barrels.

The length of lock 6 is adjusted by action of cantilevered fingers 47–50 (best shown in FIG. 2) formed by longitudinal slots 51 in outer piece 10. The slots 51 allow the fingers 47–50 to be displaced radially inwardly and outwardly relative to the longitudinal axis 45. Finger 47 has a tang 23 extending radially into bore 46 of outer piece 10. The inner piece 12 includes a plurality of co-linearly aligned slots 11 spaced along a length of the inner piece 12. The tang 23 is positioned to engage any one of slots 11 in inner piece 12 to achieve discrete lengths of the assembly suitable to the barrel length of a particular firearm. Due to the inherent limits in range of adjustment, the present invention envisions a family of lock assemblies each with a limited range of adjustment, thereby having application to a wide range of firearms.

Finger 49 on outer piece 10 also incorporates a separate tang 26 that extends radially into bore 46. Tang 26 engages a continuous slot 24 (best shown in FIG. 4) in inner piece 12 to prevent or limit rotation between inner and outer pieces 10 and 12 while allowing sliding collaboration for length adjustment. Tang 26 engages the ends of the continuous slot 24 to keep the assembly together while adjusting for length. The remaining two fingers 48 and 50 on outer piece 10 serve as positioners to guide and retain inner and outer pieces 10 and 12 together.

Referring again to FIG. 2, the rear portion 44 of inner piece 12 is slotted to create four cantilevered fingers 52–55. Two of the fingers 52 and 53 are radially moveable relative to the longitudinal axis 45 and form the lugs 13 for securing the lock 6 within a firearm. As described above, the lugs 13 are radially movable between a radially expanded orientation (shown in FIGS. 8 and 10) and a radially contracted orientation (shown in FIG. 9). When in the expanded orientation, shoulders 56 of the locking lugs 13 are adapted to engage a shoulder in the firing chamber of the firearm 1 to secure the firearm lock 6 in the firearm rendering the firearm unfireable.

Figure 3:
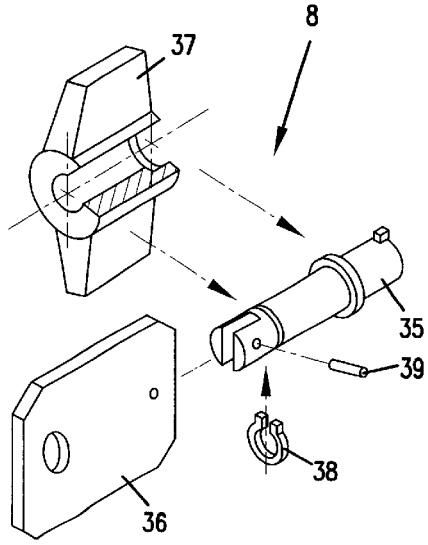
FIG. 3 is an exploded perspective view of a key for use with the firearm lock of FIG. 1.

Fingers 54 and 55 on inner piece 12 perform different, but complimentary functions. For example, the finger 55 defines the discretely positioned slots or holes 11 (described above) which receive tang 23 on finger 47 of outer piece 10 to effect length adjustments. Also, Finger 54 defines the longitudinal slot 24 which engages tang 26 on finger 49 of outer piece 10 to prevent rotation between the inner and outer pieces 10 and 12 while allowing longitudinal relative motion Referring again to FIG. 1, the depicted key 8 for locking and unlocking the lock 6 includes a tubular key shaft 35, a key handle 36 for gripping the key 8, and an anti-rotation grip 37, within which the key shaft 35 can rotate. The parts of key 8 are joined together by keeper ring 38 (i.e., a snap ring) and pin 39 or other suitable means (see FIG. 3). The grip 37 includes anti-rotation lugs 40 (shown in FIG. 1) that project outwardly from an axial end face of the grip 37. The key shaft 35 is shown including a front tab 75.

The lock 6 preferably includes a keyway structure 72 (i.e., a structure adapted for receiving a key such as key 8) mounted within the outer piece 10. Preferably, the keyway structure 72 is a tubular key lock such as those widely used in vending machines and other applications requiring resistance to tampering. This family of keyed locks also lends itself to miniaturization, allowing a majority of the keyway structure to be concealed and protected within the bore of the firearm. In a preferred embodiment, the lock 6 is configured such that less than 0.10 inches of the lock 6 protrudes outside the barrel of the firearm when the lock is secured therein. In other embodiments, less than 0.25 or less than 0.5 inches of the lock 6 protrudes outside the barrel. While tubular key locks are preferred, it will be appreciated that other conventional locking configurations could also be used. Further, for certain applications, a combination type lock may be desirable.

Figure 2:
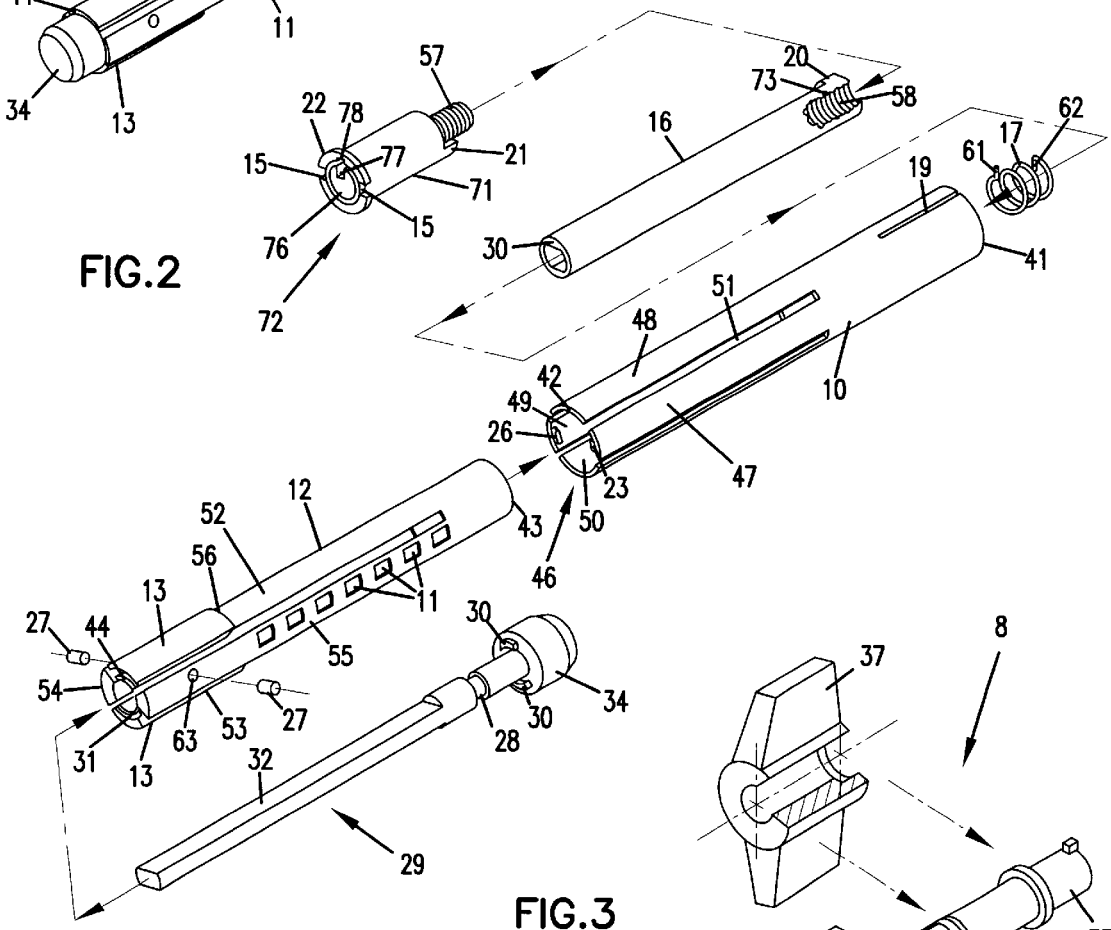
FIG. 2 is an exploded perspective view of the firearm lock of FIG. 1.

As shown in FIG. 2, the keyway structure 72 includes a tubular casing 71 having a front radial collar 22 (i.e., a lip or flange) adapted to engage (e.g., abut or seat against) the end of the barrel of a firearm. Anti-rotation slots 15 are formed within the collar 22. The slots 15 are sized to receive the lugs 40 of the grip 37 when the key 8 is inserted in the keyway structure 72. A travel limiter 21 is provided at a rear end of the casing 71. Preferably, the outer diameter of the casing 71 is a close fit within outer piece 10. The two may be joined permanently by use of engineered, high strength adhesive or other suitable means.

The keyway structure 72 also includes an inner locking member 76 rotatably mounted within the casing 71. The inner locking member 76 defines a front notch 77 adapted to align with a corresponding notch 78 defined by the collar 22. When the notches are aligned as shown in FIG. 2, the notches cooperate to define an opening sized to receive the front tab 75 of the key 8 to allow the key 8 to be inserted into or removed from the keyway structure 72. A circular gap is defined between the locking member 76 and the casing 71 for receiving the tubular key shaft 35. The locking member 76 also includes a male threaded section 57.

Referring still to FIG. 2, the lock 6 further includes a cam sleeve 16 and a cam shaft 29. The cam sleeve 16 includes a female thread 58 for receiving the male threaded section 57 of the locking member 76 such that the sleeve 16 and the locking member 76 are coupled together. The male thread 57 on locking member 76 may be bonded to the female thread 58 of cam sleeve 16 by high strength adhesive or other suitable means. Alternatively, locking member 76 and cam sleeve 16 may be formed as a single piece. The integral keyway structure 72 and cam sleeve 16 are preferably positioned within the outer piece 10 of the lock 6.

Figure 7:
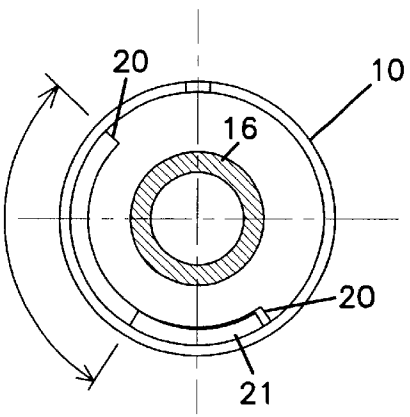
FIG. 7 is a cross-sectional view taken along line 7—7 in FIG. 4.

An angular travel limiter 20 is formed on the external surface of cam sleeve 16. When the lock 6 is assembled, the travel limiter 20 and the travel limiter 21 of the casing 71 cooperate to limit the relative rotation possible between the casing 71 and the cam sleeve 16 to a predetermined range (e.g., about 90 degrees as best shown in FIG. 7).

Figure 6:
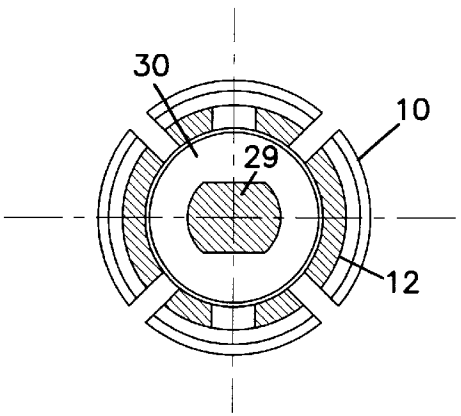
FIG. 6 is a cross-sectional end view taken along line 6—6 in FIG. 4.

The cam sleeve 16 also defines a longitudinal opening/bore that forms a drive end 30 for receiving the cam shaft 29. The cam shaft 29 is a rod-like member with flat sides that correspond to and slidably engage within the drive end 30 of cam sleeve 16 (i.e., the drive end 30 and the cam shaft 29 have a complementary shape as best shown in FIG. 6). The cam shaft 29 inserts through the rear end 44 of the inner piece 12 and mates with the drive end 30 of cam sleeve 16. As such, cam shaft 29 is indirectly connected to the locking member 76 of the keyway structure 72 through their mutual engagement with cam sleeve 16. Thus, the locking member 76, the sleeve 16 and the cam shaft 29 are adapted to rotate about the longitudinal axis 45 in unison as a common shaft or member.

Figure 5:
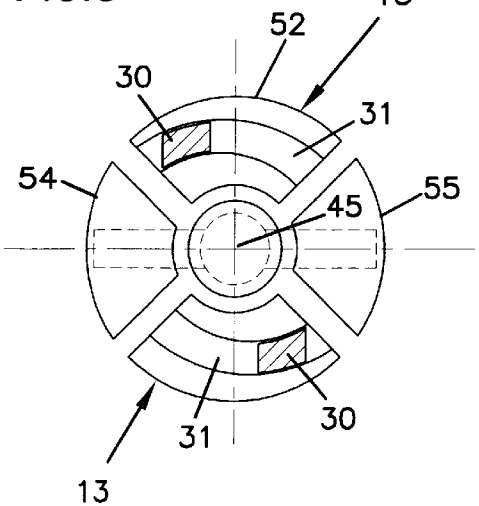
FIG. 5 is a cross-sectional view taken along line 5—5 in FIG. 4.

Cam shaft 29 also engages inner piece 12. A cam head 34 is formed at one end of cam shaft 29. Cam lugs 30 or pins are formed on cam head 34. Cam lugs 30 fit into and are free to move within cam slots 31 formed in lugs 13 on inner piece 12. As best shown in FIG. 5, the cam slots 31 are eccentric relative to the longitudinal axis 45. Thus, rotation of the cam head 34 in a first direction relative to the lugs 13 (e.g., clockwise with respect to FIG. 5) will cause the cam lugs 30 to force the lugs 13 radially outwardly. By contrast, rotation of the cam head 34 in a second direction relative to the lugs 13 (e.g., counterclockwise with respect to FIG. 5) will cause the cam lugs 13 to force the lugs 13 radially inwardly.

Figure 8:
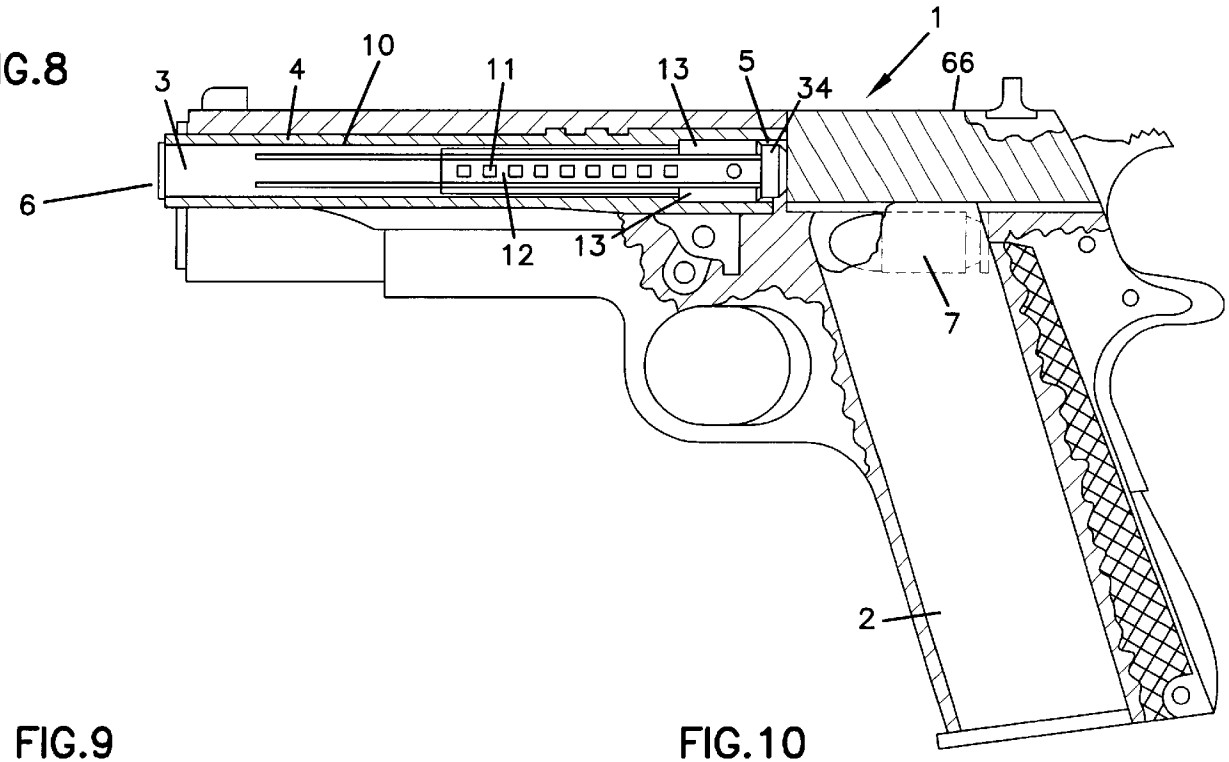
FIG. 8 illustrates the firearm lock of FIG. 1 locked within a firearm with portions of the firearm cut-away to better show the lock mounted therein.
Figure 9:
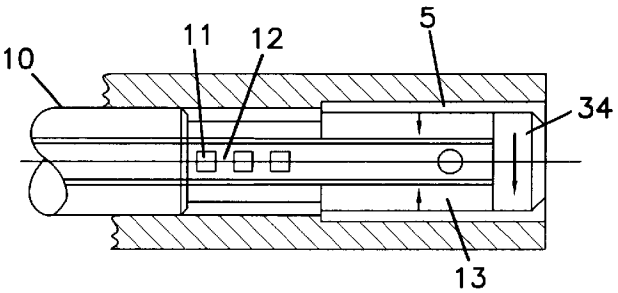
FIG. 9 is an enlarged view of a portion of FIG. 8 showing the rear portion of the firearm lock in an unlocked position within the firing chamber of the firearm.

It will be appreciated that FIG. 5 shows the cam lugs 13 in the radially contracted orientation of FIG. 9. It will further be appreciated that the cam head 34 is rotated through the use of the key 8. For example, by inserting the key 8 in the keyway structure 72 and then turning the key, torque is transferred to the locking member 76 which causes the sleeve 16, the cam shaft 29 and the cam head 34 to rotate in unison. When the key 8 is rotated in a first direction, the cam lugs 13 are moved toward the radially expanded orientation of FIGS. 8 and 10. By contrast, when the key 8 is rotated in a second direction, the cam lugs 13 are moved toward the radially contracted orientation of FIG. 9. The travel limiters 20 and 21, described above, prevent the key 8 from being over-rotated.

The cam shaft 29 is preferably longitudinally fixed relative to the inner piece 12. For example, the fingers 54 and 55 on inner piece 12 are shown including holes 63 (only one shown in FIG. 2) into which dowel pins 27 are permanently installed by interference fit or other suitable means. When cam shaft 29 is properly aligned within inner piece 12, dowel pins 27 extend through fingers 54 and 55 to engage groove 28 in cam shaft 29. Pins 27 position cam shaft 29 longitudinally and radially relative to inner piece 12 and ensure that cam lugs 30 remain engaged in eccentric cam slots 31.

Figure 10:
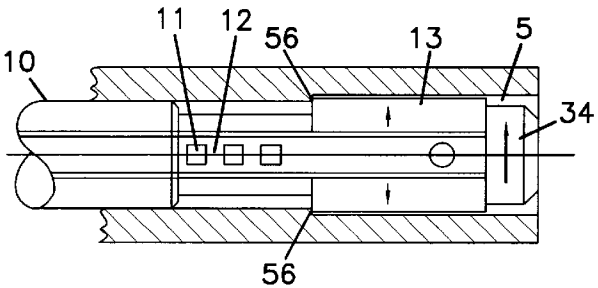
FIG. 10 is an enlarged view of a portion of FIG. 8 showing the rear portion of the firearm lock in a locked position within the firing chamber of the firearm.

The firearm lock 6 further includes the torsional spring 17 for biasing the lock toward the locked position of FIGS. 8 and 10. The spring 17 includes a first end 61 and second end 62. As shown in FIG. 2, cam sleeve 16 passes through spring 17 and engages second end 62 of spring 17. When assembled, the spring is mounted within the outer piece 10 with a radially outwardly projecting portion of the first end 61 of spring 17 inserted within a slot 19 formed proximate front end 42 of outer piece 10, and a radially inwardly projecting portion of the second end 62 of the spring in engagement with a hole 73 defined by the sleeve 16. When the lock 6 is in the locked position of FIGS. 8 and 10, the spring is preferably in a state of reduced tension (e.g., the spring is at rest). By contrast, when the key 8 is used to move the lock 6 from the expanded orientation to the contracted orientation, the relative rotation between the sleeve 16 and the outer piece 10 causes the spring to elastically deform. Thus, the spring 17, so deformed, serves to bias the cam sleeve 16 and thus the locking member 76 of the keyway structure 72 to the locked position when key 8 is released. Additionally, internal bias within the flexed cantilever fingers 55, 54 also provides a spring action which urges the lock toward the locked position.

The keyway structure is preferably of the key retaining type. Thus, when the key is engaged with the lock and rotated toward the unlocked position, the key and the lock are mechanically coupled. For example, when the keyway structure is in the locked position, the notch 78 of the casing 71 aligns with the notch 77 of the locking member 76. Thus, sufficient clearance is provided for allowing the tab 75 of the key 8 fit into the keyway structure 72. However, upon rotation of the key 8 from the locked position toward the unlocked position, the notches become misaligned. In the misaligned position, the tab 75 engages the inner side of the collar 22 of the casing 71 thereby preventing the key 8 from being removed from the keyway 72.

In operation, the length of the lock 6 is adjusted to correspond to the firearm desired to be locked. For example, the lock is preferably sized such that the cam head 34 is positioned in the firing chamber of the firearm when the collar 22 abuts against the end of the muzzle of the firearm. The key 8 is then inserted into the tubular keyway 72. Upon insertion, the anti-rotation lugs 40 are engaged with the anti-rotation slots 15 in the collar 22. Turning the key handle 36 clockwise 90 degrees while holding the anti-rotation grip 37 fixed causes the cam shaft 29 to rotate relative to outer and inner pieces 10 and 12 of the lock 6. As the cam shaft 29 rotates, the locking lugs 13 are caused to retract from their predisposed expanded (i.e., locked) position to a diameter able to pass freely by the muzzle and into the bore of the gun.

When the anti-rotation lip 22 bottoms on the muzzle of the gun, the lock 6 is fully inserted. Releasing the key 8 allows the internal torsional spring 17 to rotate the cam shaft 29 90 degrees counterclockwise, expanding the locking lugs 13 to their predisposed position and into engagement with the firing chamber shoulder.

Removal of the lock is accomplished by inserting the tubular key 8 into the keyway 72 while simultaneously engaging the anti-rotation lugs 40 on the key assembly with the anti-rotation slots 15 on the face of the collar 22. Turning the key 90 degrees clockwise while holding the anti-rotation grip 37 fixed rotates the cam shaft 29 to retract the locking lugs 13 from their engagement with the firing chamber shoulder. Since the key 8 is coupled with the lock 6 (e.g., by tab 75), exerting extraction force on the key 8 removes the lock from the firearm.

FIG. 8 depicts one embodiment of the current invention installed in a typical handgun 1. In this case, gun 1 shown is a model 1911 A1 semi-automatic pistol. The type and size of the gun shown, however, is only illustrative of the concept of the present invention. It is envisioned that the current invention is adaptable to a wide variety of firearm types, calibers and barrel lengths while remaining within the scope of the described concept. The handgun magazine 2 is shown installed to illustrate the handgun may be locked in a completely safe state, with no round in the firing chamber 5, yet with rounds safely readily accessible and ready for use once the lock is removed. Similarly, in a revolver, the lock would occupy the top chamber of the cylinder, yet allow rounds to occupy the remaining chambers for use once the lock is removed. Also, in the case of the revolver, the lock occupies the top chamber of the cylinder and restrains the cylinder from rotating so no round may be advanced into the firing position when the lock is in place.

The size of the firearm bore 3 in which the lock 6 resides is typically expressed as the caliber of the firearm, stated in decimal fractions of an inch or in metric terms. As an illustration a 45 caliber gun has a nominal bore diameter of 0.45 inch. A 9 millimeter caliber has a bore diameter of 9 millimeters or approximately 0.35 inch. The firearm barrel 4 is a cylindrical member defined by the muzzle at one end and the firing chamber 5 at the opposite end. In the case of an automatic pistol as shown, a slide 66 reciprocates during firing of the gun to discharge spent cartridge cases and insert a new round 7 into the firing chamber 5. The slide 66 in this illustration is shown closed and in close proximity to the end of the firearm lock 6.

FIGS. 9 and 10 show cross-sectional views of a portion of the gun 1 of FIG. 8 with the lock 6 inserted therein. Specifically, the portion of the lock 6 is shown that is positioned within the firing chambers. In FIG. 9, the lock is in the unlocked position with lugs 13 in a retracted position. FIG. 10 shows lock 6 in the locked position with lugs 13 radially extended outward. In the locked position, lugs engage the shoulder in the firing chamber 5 to secure the lock 6 within the gun 1. Also, when locked, lugs 13 and cam head 34 occupy substantially the entire firing chamber 5.

As shown, the lock 6 is nearly completely contained within the bore of the firearm. The bore thus provides protection against tampering. This feature of containment within the bore also adds an aesthetic value permitting the firearm to be displayed without objectionable protuberances. The present invention also does not interfere with holstering or close fitting protective cases with the lock in place.

The small lip 22 that extends slightly from the end of the gun does not compromise the ability of the lock 6 to resist tampering. Even if the lip 22 were to be forcefully removed, the lock 6 will continue to secure the firearm since the locking lugs 13 are predisposed outward to engage the firing chamber shoulder and can only be disengaged from the firing chamber shoulder by insertion of the matching key 8 and turning of the key 8 relative to the outer piece 10 to retract the locking lugs 13 clear of the firing chambers. In fact, if the small lip 22 that extends from the muzzle where to be removed by mechanical means, this defeats the anti-rotation function and the lock would not be removable, since the entire lock 6 would likely spin freely in the gun bore as the key 8 is turned. If the entire lock 6 spins within the gun bore, the lock 6 will remain biased in the locked position.

The embodiment illustrated in the drawings is also resistant to other forms of forceful tampering. If an attempt is make to drill out the primary tubular key cam lock, a careful operation could succeed, however, again the locking lugs 13 would remain engaged with the firing chamber shoulder due to their normal outward disposition. A more determined deep drilling into the firing chamber may result in destruction of the lock, but would likely destroy the functionality of the firearm due to damage to its finely tooled inner diameters and rifling.

Likewise, the present invention resists attempts to defeat it by forceful tampering at the opposite or chamber end of the gun. This end of the device is protected by the hardened cam head 34 which is cylindrical in shape and positioned to guard the locking lugs 13 from external manipulation. A tool of sufficient hardness to defeat the lock 6 from the chamber end would likely damage the firing chamber 5, making the firearm inoperable.

It will be appreciated that the anti-rotation structure (i.e., the lugs 40 and the slots 15) used by the lock 6 is significant because this structure does not depend upon any structural components of the gun (e.g., a gun sight) to prevent rotation of the outer portion of the lock 6 relative to the gun barrel. Thus, the lock 6 can readily be used with different gun models and designs. Also, while the lock is shown used with a magazine-type automatic pistol, the lock can also be used with other types of guns such as revolvers, rifles, shotguns, etc.

With regard to the foregoing description, it is to be understood that changes may be made in detail, especially in matters of the construction materials employed and the shape, size and arrangement of the parts without departing from the scope of the present invention. It is intended that the specification and depicted aspects be considered exemplary only, with a true scope and spirit of the invention being indicated by the broad meaning of the following claims.

What is claimed is as follows:

1. A safety device for a firearm having a firing chamber and a bore, the safety device comprising:

an elongated lock body including opposite first and second ends, the elongated lock body including first and second portions that are telescopically moveable relative to each other to allow a length of the elongated lock body to be adjusted;

an engagement member positioned adjacent the first end of the elongated lock body, the engagement member being movable between a locked position and an unlocked position, the engagement member being adapted to engage the firing chamber when in the locked position to prevent the lock body from being removed from the firearm, the lock body being removable from the gun when the engagement member is in the unlocked position;

a keyway for receiving a key that is used to move the engagement member between the locked and unlocked positions, the keyway being positioned adjacent the second end of the elongated lock body; and a shaft structure positioned within the elongated lock body that operatively connects the keyway to the engagement member, the shaft structure being rotatable within the elongated lock body, and the shaft structure including first and second pieces that slide relative to one another when the length of the elongated lock body is adjusted.

2. The safety device of claim 1, further comprising a camming mechanism driven by the shaft structure for moving the engagement member between the locked and unlocked positions.

3. The safety device of claim 1, wherein the first portion of the elongated lock body interlocks with the second portion at a plurality of discrete positions, each of the discrete positions defining a different length of the elongated body.

4. The safety device of claim 3, wherein the engagement member is integral with the elongated lock body.

5. The safety device of claim 3, further comprising a cam structure for moving the engagement member between the locked and unlocked positions, wherein rotation of the shaft structure between first and second positions causes the cam structure to move the engagement member between the locked and unlocked positions.

6. The safety device of claim 5, wherein the engagement member includes a plurality of lugs, and wherein the safety device is sized to substantially occupy the firing chamber when the lugs are in the locked position.

7. The safety device of claim 5, wherein the engagement member includes an end face defining a cam slot that is eccentric relative to an axis of rotation of the shaft structure, wherein the cam structure includes a lug that fits within the cam slot, and wherein rotation of the shaft structure about the axis of rotation causes the lug to slide along a length of the slot and provide radial displacement of the engagement member between the locked and unlocked positions.

8. The safety device of claim 7, wherein the bore of the firearm is defined by a barrel, and wherein less that 0.25 inches of the elongated lock body protrudes beyond an end of the barrel when the elongated lock body is locked within the firearm such that the barrel protects the safety device against tampering.

9. The safety device of claim 1, further comprising a spring that biases the engagement member toward the locked position.

10. The safety device of claim 1, wherein the firearm includes a barrel, wherein the length of the elongated lock body can be adjusted to extend an entire length of the barrel, and wherein a majority of the keyway is protected within the barrel when the safety device is locked within the gun.

11. The safety device of claim 1, wherein the firearm includes a barrel defining the bore, wherein the barrel has a muzzle end, and wherein the elongated lock body includes an end flange that abuts against the muzzle end of the barrel when the safety device is locked within the firearm.

12. The safety device of claim 1, wherein the first and second pieces of the shaft structure side telescopically relative to one another.

13. The safety device of claim 1, wherein the firearm includes a barrel defining the bore, wherein the barrel has a muzzle end, wherein the elongated lock body includes an end flange that abuts against the muzzle end of the barrel when the lock is locked within the firearm, and wherein the flange includes an anti-rotation structure for preventing the elongated lock body from rotating in concert with the shaft structure.

14. The safety device of claim 13, wherein the key includes a first portion that fits within the keyway, and a second portion that interlocks with the anti-rotation structure of the elongated lock body, the second portion including a grip for allowing a user to hold the second portion in place as the first portion is rotated relative to the second portion.

15. The safety device of claim 14, wherein the anti-rotation structure includes one or more notches defined by the flange of the elongated lock body.

16. A safety device for a firearm having a firing chamber and a bore, the safety device comprising:

a lock including a shaft structure rotatable about a longitudinal axis between a first rotational position and a second rotational position;

a keyway operably connected to the shaft structure, the keyway adapted to receive a key for use in manually rotating the shaft structure;

an engagement member operatively connected to the shaft structure such that the engagement member moves to a locked position when the shaft structure is rotated to the first rotational position, and moves to an unlocked position when the shaft structure is rotated to the second rotational position, the engagement member being adapted to engage the firing chamber when in the locked position to prevent the lock from being removed from the firearm, and the lock being removable from the gun when the engagement member is in the unlocked position;

a biasing structure for biasing the shaft structure toward the first rotational position such that the engagement member is biased toward the locked position; and a key for moving the shaft structure between the first and second rotational positions, the key being removable from the lock only when the engagement member is in the locked position.

17. A gun assembly comprising:

a gun having a firing chamber and a barrel defining a bore;

a lock including an elongated body inserted within the bore, the elongated body having an adjustable length set to extend through an entire length of the bore, the elongated body including a lip that engages a muzzle end of the barrel, the lock also including an engagement member operatively connected to the elongated body, the engagement member movable between a locked position and an unlocked position, the engagement member engaging the firing chamber when in the locked position to prevent the lock from being removed from the firearm, the lock being removable from the gun when the engagement member is in the unlocked position, the lock further including a keyway positioned at the muzzle end of the barrel and operatively coupled to the engagement member by a shaft and cam arrangement, the keyway receiving a key for moving the engagement member between the locked and unlocked positions; and wherein a majority of the keyway is protected in the barrel at the muzzle end of the gun.

18. The safety device of claim 17, wherein the lock is sized such that substantially the entire lock is positioned within the bore of the gun when the engagement member is in the locked position within the firing chamber.

19. A gun assembly comprising:

a gun having a firing chamber and a barrel defining a bore, the barrel having a muzzle end; and a lock including an elongated body inserted within the bore, the lock also including an engagement member operatively connected to the elongated body, the engagement member movable between a locked position and an unlocked position, the engagement member engaging the firing chamber when in the locked position to prevent the lock from being removed from the firearm, the lock being removable from the gun when the engagement member is in the unlocked position, the lock including a keyway for receiving a key that is used to move the engagement member between the locked and unlocked positions, the keyway being positioned at the muzzle end of the barrel and a majority of the keyway being protected within the barrel when the lock is locked within the gun.

20. The gun assembly of claim 18, further comprising the key, wherein the key includes an inner portion that is rotatable relative to an outer portion, the inner portion being adapted to fit within the keyway and the outer portion including an anti-rotation grip that interlocks with the elongated body to prevent the elongated body from rotating within the barrel when the key is turned.

21. The safety device of claim 19, wherein the elongated body extends through an entire length of the bore.

22. The safety device of claim 21, wherein the keyway is mounted to a first end of the elongated body, and the engagement member is located adjacent a second end of the elongated body.

23. The safety device of claim 19, wherein the gun is adapted to be holstered with the lock locked therein.

24. A safety device for a firearm having a firing chamber and a barrel defining a bore, the safety device comprising:

a lock including an elongated body sized to be inserted within the bore, the lock also including an engagement member operatively connected to the elongated body, the engagement member movable between a locked position and an unlocked position, the engagement member being adapted to engage the firing chamber when in the locked position to prevent the lock from being removed from the firearm, the lock being removable from the gun when the engagement member is in the unlocked position, and the lock being sized such that substantially the entire lock is positioned within the bore of the gun when the engagement member is in the locked position within the firing chamber;

the lock including a rotatable portion mounted at least partially within the elongated body for moving the engagement member between the locked and unlocked positions;

the elongated body including an end flange adapted to abut against a mussel end of the barrel when the lock is locked within the firearm, the flange including an anti-rotation structure; and the lock including a key including a first portion for rotating the rotatable portion of the lock, and a second portion that interlocks with the anti-rotation structure of the elongated body, the second portion including a grip for allowing a user to hold the second portion in place as the first portion is rotated relative to the second portion.

25. The safety device of claim 24, wherein the anti-rotation structure includes one or more notches defined by the flange of the elongated body.

26. A gun assembly comprising:

a gun having a firing chamber and a barrel defining a bore;

a lock including an elongated body inserted within the bore, the elongated body having an adjustable length set to extend through an entire length of the bore, the elongated body including a lip that engages a muzzle end of the barrel, the lock also including an engagement member operatively connected to the elongated body, the engagement member movable between a locked position and an unlocked position, the engagement member engaging the firing chamber when in the locked position to prevent the lock from being removed from the firearm, the entire lock being removable from the gun through the muzzle end of the barrel when the engagement member is in the unlocked position, the lock further including a key engagement portion operatively coupled to the engagement member, the key engagement portion being adapted to engage a key that is used to move the engagement member between the locked and unlocked positions; and wherein a majority of the key engagement portion is protected in the barrel when the lock is locked within the gun.

27. The gun assembly of claim 26, wherein the lock includes a cam for moving the engagement member between the locked and unlocked positions.

28. A gun assembly comprising:

a gun having a firing chamber and a barrel defining a bore, the barrel having a muzzle end; and a lock including an enlongated body inserted within the bore, the lock also including an engagement member operatively connected to the elongated body, the engagement member movable between a locked position and an unlocked position, the engagement member engaging the firing chamber when in the locked position to prevent the lock from being removed from the firearm, the entire lock being removable from the gun through the muzzle end of the barrel when the engagement member is in the unlocked position, the lock including a key engagement portion for engaging a key that is used to move the engagement member between the locked and unlocked positions, and a majority of the key engagement portion being protected within the barrel when the lock is locked within the gun.

29. The gun assembly of claim 28, wherein the lock includes a cam for moving the engagement member between locked and unlocked positions.

* * * * *